United States Patent [19]

Hu

[11] Patent Number: 4,928,732

[45] **Date of Patent: * May 29, 1990**

[54] FLUID FAUCET

[75] Inventor: Lee-Ping Hu, Taipei Hsien, Taiwan

[73] Assignee: Hydrotek Corporation, Nan-Tou, Taiwan

[ * ] Notice: The portion of the term of this patent subsequent to May 3, 2005 has been disclaimed.

[21] Appl. No.: 174,782

[22] Filed: Mar. 29, 1988

Related U.S. Application Data

[60] Division of Ser. No. 925,498, Oct. 29, 1986, Pat. No. 4,741,363, which is a continuation of Ser. No. 784,709, Oct. 4, 1985, abandoned, which is a continuation of Ser. No. 574,670, Jan. 27, 1984, abandoned.

[51] Int. Cl.[5] ..... F16K 11/20; F16K 31/40

[52] U.S. Cl. ..... 137/607; 137/613; 251/129.04

[58] Field of Search ..... 137/607, 613, 614, 625.41; 251/129.04; 4/304, 305, 623, DIG. 3

[56] References Cited

U.S. PATENT DOCUMENTS

| | | | |
|---|---|---|---|
| 2,706,492 | 4/1955 | Horland . | |
| 2,935,079 | 5/1960 | Shelton | 137/625.41 |
| 3,328,592 | 6/1967 | Shaw . | |
| 3,415,278 | 12/1968 | Yamamoto et al. . | |
| 3,460,571 | 8/1969 | Moen . | |
| 3,556,146 | 1/1971 | Groen . | |
| 3,576,277 | 4/1971 | Blacknion . | |
| 3,584,636 | 6/1971 | Pettis, Jr. . | |
| 3,585,653 | 6/1971 | Forbes et al. | 4/623 |
| 3,638,680 | 2/1972 | Kopp | 137/607 |
| 3,724,913 | 4/1973 | Levy . | |
| 3,799,198 | 3/1974 | Kijimoto | 137/624.11 |
| 3,901,261 | 8/1975 | Riis . | |
| 4,141,383 | 2/1979 | Geimer . | |
| 4,207,466 | 6/1980 | Drage et al. | 250/338 |
| 4,222,410 | 9/1980 | Geimer . | |
| 4,298,280 | 11/1981 | Harney . | |
| 4,305,021 | 12/1981 | Schreiden . | |
| 4,309,781 | 1/1982 | Lissau | 4/623 |
| 4,402,095 | 9/1983 | Pepper | 4/305 |
| 4,741,363 | 5/1988 | Hu | 137/607 |

FOREIGN PATENT DOCUMENTS

| | | |
|---|---|---|
| 1658176 | 9/1970 | Fed. Rep. of Germany . |

*Primary Examiner*—Stephen Hepperle

*Attorney, Agent, or Firm*—Merchant, Gould, Smith, Edell, Welter & Schmidt

[57] ABSTRACT

A fluid faucet includes a first passage having a first mouth and connected to a first fluid source, a second passage having a second mouth and connected to a second fluid source, a hollow cylinder having a first hole and a second hole, a third passage having a third mouth for passing a fluid mixed from the first and second fluids, an electromagnetic valve having a valve stem engagable with the third mouth and an infrared coupling-and-controlling circuit. The first and second holes are capable of respectively fully shielding or communicating with the first and second mouths when the hollow cylinder is rotated. The infrared coupling-and-controlling circuit actuates the electromagnetic valve to set the valve stem to be in disengagement with the third mouth to permit the mixed fluid passing through the third mouth when a body is in a distance close enough to such a faucet.

3 Claims, 4 Drawing Sheets

FLUID FAUCET

This is a division, of application Ser. No. 925,498, filed Oct. 29, 1986 now U.S. Pat. No. 4,741,363, which was a continuation of application Ser. No. 784,709, filed Oct. 4, 1985, which was a continuation of application Ser. No. 574,670 originally filed Jan. 27, 1984.

BACKGROUND OF THE INVENTION

The present invention relates to a fluid faucet, and more particularly to a faucet incorporating a controlling means to discharge a fluid when a body is sensed to be close enough to the faucet.

The known fluid faucets, e.g. water faucets are closed and opened by rotating their handwheels. It is our experience that the handwheels are prone to contaminations of various kinds. Moreover, it will make the situation worse for the handwheels of a public building. Besides, for the output of a uniform mixed fluid one must separately set the opening amounts of two faucets on two fluid suppliers. To the applicant's knowledge, at present, there is not a faucet which can accommodate the discharging quantities of two fluid only by an adjusting medium or bears no handwheel.

SUMMARY OF THE INVENTION

It is therefore an object of the present invention to provide a fluid faucet capable of working without a handwheel to be rotated.

It is therefore another object of the present invention to provide a fluid faucet which can accommodate the discharging quantities of two kinds of fluids only by an adjusting medium.

It is yet another object of the present invention to provide a fluid faucet capable of saving the fluid from avoidable consumption.

According to the present invention, a fluid faucet includes a first passage having a first mouth and adapted to be connected to a first fluid source and a controlling means capable of disengaging with the first mouth when a body is close enough to the faucet to allow a first fluid from the first fluid source passing through the first mouth and engaging with the first mouth when the body is remote enough from the faucet to prevent the first mouth from passing the first fluid.

The faucet can further include a second passage having a second mouth and adapted to be connected to a second fluid source and the second mouth is to be in communication with the first mouth such that the controlling means is capable of disengaging and engaging with the first and second mouths at the same time.

Preferably the faucet further includes a guarding means acting as an adjusting medium for adjusting the opening amount of each of the first and second mouths.

Typically, the guarding means is a hollow cylinder and includes a first hole capable of fully escaping from the first mouth when the cylinder is in a first position and fully communicating with the first mouth when the cylinder is in a second position and a second hole capable of fully escaping from the second mouth when the cylinder is in the second position and fully communicating with the second mouth when the cylinder is in the first position so that the cylinder can guard the opening mounts of both of the first and second mouths when the cylinder is in a position between the first and second positions to accommodate the passing quantities, passed through the first and second mouths, of the first fluid and a second fluid from the second fluid source.

In one embodiment, the cylinder is designed such that the change of the positions is achieved by rotating the cylinder without resulting the cylinder in axial translation.

Preferably the faucet further includes a third passage having a third mouth for passing the mixed fluid constituted from the first and second fluids and an outlet for discharging the mixed fluid.

Typically, the controlling means can include an electromagnetic valve having a valve stem engagable with the third mouth and an infrared coupling-and-controlling circuit for sensing a body to actuate the electromagnetic valve in order to set the valve stem to be in disengagement with the third mouth when the body is in a distance close enough to the faucet and de-actuating the electromagnetic valve to leave the valve stem to be in engagement with the third mouth to prevent the mixed fluid from passing through the third mouth when the body is in a distance remote enough from the faucet.

Typically, the infrared coupling-and-controlling circuit is to be powered by a regulated voltage and can include a signal generator for generating infrared rays of intermediate frequency, a receiver for receiving the infrared rays reflected from a body to effect a potential difference and for giving a voltage output obtained through amplifying the potential difference, a filter filtering the voltage output and transmitting an output signal of stabilized voltage, an amplifier amplifying the output signal and an electronic trigger receiving the amplified output signal and triggering the electromagnetic valve when the reflected infrared rays received by the receiver reach a certain quantity.

The present invention may best be understood with reference to the accompanying drawings.

DETAILED DESCRIPTION OF THE PREFERRED EMBODIMENT

Figure 1:
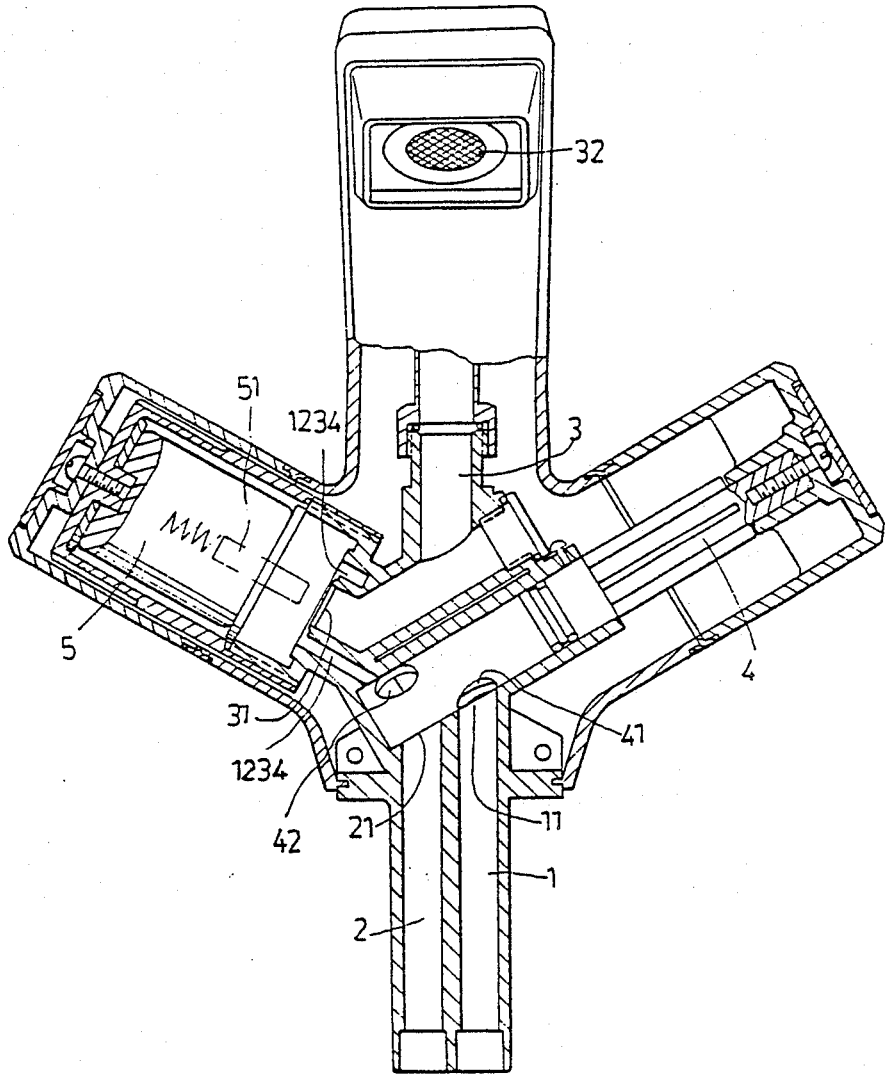
FIG. 1 is a partial sectional view showing a preferred embodiment of a fluid faucet of the present invention.
Figure 2:
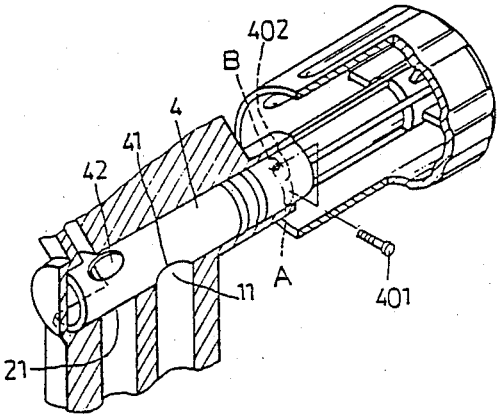
FIG. 2 is a fragmentary sectional view showing a guarding means in engagement with two fluid passages of a fluid faucet of the present invention.
Figure 3:
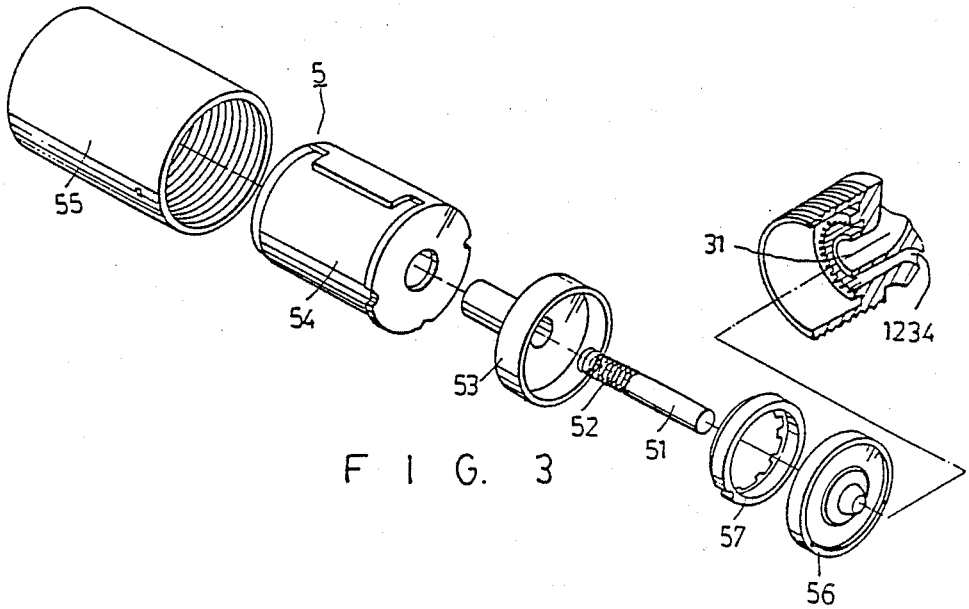
FIG. 3 is an exploded and sectional view showing how an electromagnetic valve engages with a third mouth of a third passage of a fluid faucet of the present invention.

Referring now to FIG. 1, there is shown a sectional view of the main body portion part of a preferred embodiment of a fluid faucet of the present invention, which includes a first passage 1 having a first mouth 11, a second passage 2 having a second mouth 21, a third passage 3 having a third mouth 31 and an outlet 32, a guarding means 4 having a first hole 41 and a second hole 42, an electromagnetic valve 5 having a valve stem 51 engagable with third mouth 31 and an infrared coupling-and-controlling circuit (not shown in FIG. 1). As shown in FIG. 2, guarding means 4 is designed to be a hollow cylinder axially secured by a screw 401 and confined by a groove 402 to be rotatable between two positions A and B. First hole 41 is capable of fully escaping from first mouth 11 when hollow cylinder 4 lets screw 401 contact with position A and fully communicating with first mouth 11 when screw 401 contacts position B of groove 402. Second hole 42 is capable of fully escaping from second mouth 21 when cylinder 4 lets screw 401 contact with position B and fully communicating with second mouth 21 when screw 401 contacts position A of groove 402. Thus, cylinder 4 will guard or regulate the opening amounts of both of first mouth 11 and second mouth 21 when cylinder 4 lets screw 401 be in a position between the two positions A and B. First passage 1 can pass a first fluid and second passage 2 can pass a second fluid different from the first fluid in some way, e.g. the first fluid is cold water and the second fluid is hot water. The fluid, mixed through cylinder 4, goes through a communicating passage 1234 and third mouth 31 to third passage 3 for being discharged out of outlet 32. As shown in FIG. 3, electromagnetic valve 5 includes a valve body 54, a valve stem receiver 53, a spring 52, a valve stem 51, a mouth engaging disc 56, an intermediate ring 57 and a valve cover 55. Spring 52 urges valve stem 51 to set mouth engaging disc 56 to be sealingly engaged with third mouth 31 when electromagnetic valve 5 is not actuated. Spring 52 is compressed by valve stem 51 when electromagnetic valve 5 is actuated by the infrared coupling-and-controlling circuit (will be described later), and thus, the fluid contained within communicating passage 1234 pushes mouth engaging disc 56 to axially go in the direction which spring 52 is compressed and passes through third mouth 31 to third passage 3 for being discharged from outlet 32.

Figure 6:
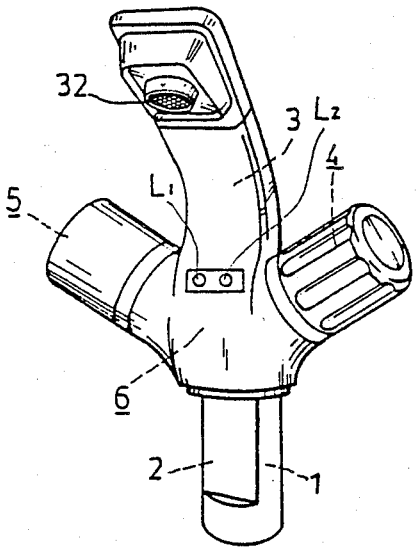
FIG. 6 is a perspective view showing the outer appearance of a fluid faucet of the present invention.

As shown in FIG. 6, a fluid faucet of the present invention can be enclosed by a smooth housing. Electromagnetic valve 5 is actuated by an infrared coupling-and-controlling circuit 6 which actuates electromagnetic valve 5 to set mouth engaging disc 56 disengaging from third mouth 31 when a body is sensed to be in a distance close enough to such a faucet and de-actuates electromagnetic valve 5 to leave disc 56 engaging with third mouth 31 to prevent the mixed fluid from passing through third mouth 31 when the body is in a distance remote enough from the present faucet.

Figure 4:
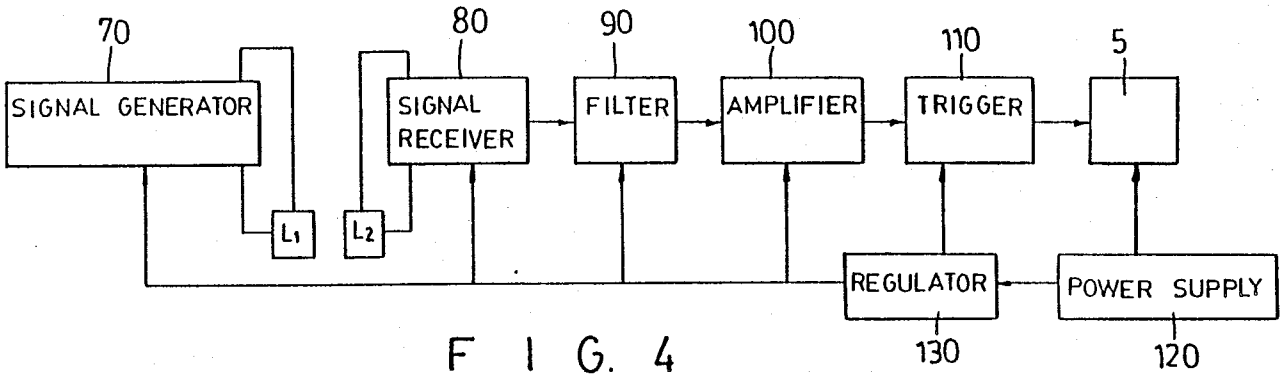
FIG. 4 is a block diagram representing an infrared coupling-and-controlling circuit of a fluid faucet of the present invention.

A typical block diagram of an infrared coupling-and-controlling circuit 6 of a fluid faucet of the present invention is shown in FIG. 4. Infrared coupling-and-controlling circuit 6 includes a signal generator 70 for generating infrared rays of intermediate frequency, a receiver 80 for receiving the infrared rays reflected from a body to effect a potential difference and for giving a voltage output obtained through amplifying the potential difference, a filter 90 filtering the voltage output and transmitting an output signal of stabilized voltage, an amplifier 100 amplifying the output signal of filter 90 and an electronic trigger 110 receiving the amplified output signal and triggering electromagnetic valve 5 when the reflected infrared rays received by receiver 80 reaches a quantity and such a circuit 6 is powered by a power supply 120 regulated by a regulator 130.

Figure 5:
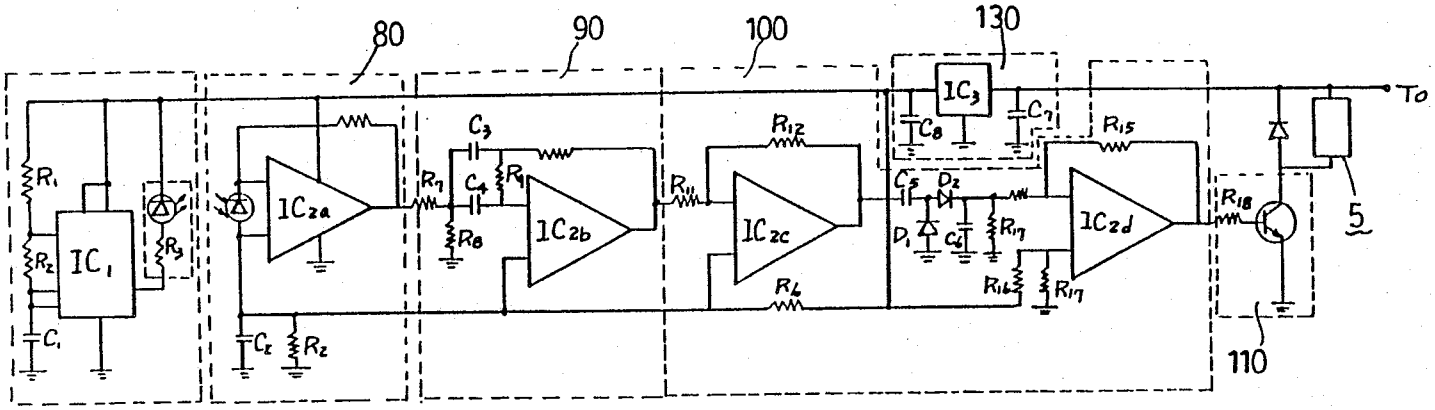
FIG. 5 is a circuit diagram of an infrared coupling-and-controlling circuit of a fluid faucet of the present invention.

A typical circuit diagram of an infrared coupling-and-controlling circuit is shown in FIG. 5 which can be read above suspicion by one skilled in the art and therefore will be not described in any more detail.

While the present invention has been described in connection with what is presently considered to be the most practical and preferred embodiment, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

What I claim is:

1. A fluid faucet comprising:

a body portion;

a first passage defined in said body portion having a first mouth and adapted for connection to a first fluid source;

a second passage defined in said body portion having a second mouth and adapted for connection to a second fluid source;

a third passage defined in said body portion having a third mouth for passing a mixed fluid therethrough;

an outlet defined in said body portion in communication with said third passage for discharging the mixed fluid;

a guarding valve means adjacent said first and second passages for selectively sealing each of said first and second mouths, said guarding valve means having a first hole defined therein which is not in communication with said first mouth when said guarding means is in a first position and fully communicates with said first mouth when said guarding means is in the second position, and a second hole defined therein which is not in communication with said second mouth when said guarding means is in the second position and fully communicates with said second mouth when said guarding means is in the first position, a chamber defined therein in communication with said first and second holes, and a third hole defined therein in communication with said chamber for permitting the mixed fluid to enter said third passage, whereby said guarding means will control the opening amounts of both of said first and second mouths to regulate fluid passed through said first and second mouths from the first and said second fluid sources;

a handle connected to said guarding valve means for moving said guarding valve means between the first position and the second position without resulting in axial translation of said guarding valve means;

mouth engaging disk means for sealingly engaging said third mouth;

electromagnetic valve actuating means for engaging said disk means, whereby actuation of said actuating means results in displacement of the disk means to allow fluid to pass from said third mouth to said third passage and to thus be discharged from said outlet, said valve including means for sensing a body and a circuit means for actuating said electromagnetic valve actuating means when a body is sensed by said sensing means to be near said faucet and for deactuating said electromagnetic valve actuating means when the body is at a distance from said faucet, wherein said circuit means includes an infrared coupling and controlling circuit which is powered by a voltage regulator.

2. A fluid faucet according to claim 1 wherein said coupling and controlling circuit includes:

signal generator means for generating infrared rays of intermediate frequency;

a receiver for receiving infrared rays deflected from the body to effect a potential difference and for emitting a voltage output obtained through amplifying said potential difference;

filter means for filtering the voltage output and transmitting an output signal of stabilized voltage;

an electronic trigger means for receiving the output signal and triggering said electromagnetic valve actuating means when said reflected rays received by said receiver reach a certain quantity.

3. A fluid faucet according to claim 1, wherein said circuit includes:

signal generator means for generating infrared rays of intermediate frequency;

a receiver for receiving infrared rays reflected from the body to effect a potential difference and for emitting a voltage output obtained through amplifying said potential difference;

filter means for filtering the voltage output and transmitting an output signal of stabilized voltage;

an amplifier for amplifying said output signal; and an electronic trigger means for receiving the amplified output signal and triggering said electromagnetic valve when said reflected rays received by said receiver reach a certain quantity.

* * * * *